United States Patent [19]

Caires

[11] Patent Number: 4,905,128

[45] Date of Patent: Feb. 27, 1990

[54] LIPSTICK APPLICATION ASSISTING DEVICE

[76] Inventor: Richard Caires, 45 W. 60th St., New York, N.Y. 10023

[21] Appl. No.: 227,898

[22] Filed: Aug. 3, 1988

[51] Int. Cl.[4] ..... F21V 33/00

[52] U.S. Cl. ..... 362/109; 362/136; 206/385

[58] Field of Search ..... 362/109, 135, 136, 138; 206/385; 401/49, 88, 94

[56] References Cited

U.S. PATENT DOCUMENTS

| | | | |
|---|---|---|---|
| 1,496,575 | 6/1924 | Hanna | 362/136 |
| 2,021,015 | 11/1935 | Muller | 362/136 |
| 2,185,149 | 12/1939 | Hallbauer | 362/136 |
| 2,468,640 | 4/1949 | Santilli | 362/135 |
| 2,598,153 | 5/1952 | Ziuraitis | 362/136 |
| 2,645,706 | 7/1953 | Bowland | 362/135 |
| 2,779,344 | 1/1957 | Hemmings et al. | 362/136 |
| 2,789,207 | 4/1957 | Novakovich | 362/135 |
| 3,053,381 | 9/1962 | Schmid | 206/385 |
| 3,214,012 | 10/1965 | Mack | 206/385 |
| 3,217,154 | 11/1965 | Owen | 362/136 |
| 4,032,772 | 6/1977 | Mowbray | 362/136 |

FOREIGN PATENT DOCUMENTS

| | | | |
|---|---|---|---|
| 494371 | 3/1950 | Belgium | 362/109 |
| 829652 | 1/1952 | Fed. Rep. of Germany | 362/109 |
| 551375 | 11/1956 | Italy | 362/109 |

*Primary Examiner*—James C. Yeung

*Attorney, Agent, or Firm*—Michael J. Striker

[57] ABSTRACT

A lipstick application assisting device comprises a housing, a receptacle formed in the housing so as to accommodate a lipstick, a mirror provided on the housing, and an illuminating element including a switch, a power supply activated and deactivated by the switch, and an electric light source supplied from the power supply during its activation and arranged so that its light is directed toward user's lips so as to illuminate the user's lips and to obtain in the mirror an illuminated image of the user's lips.

13 Claims, 3 Drawing Sheets

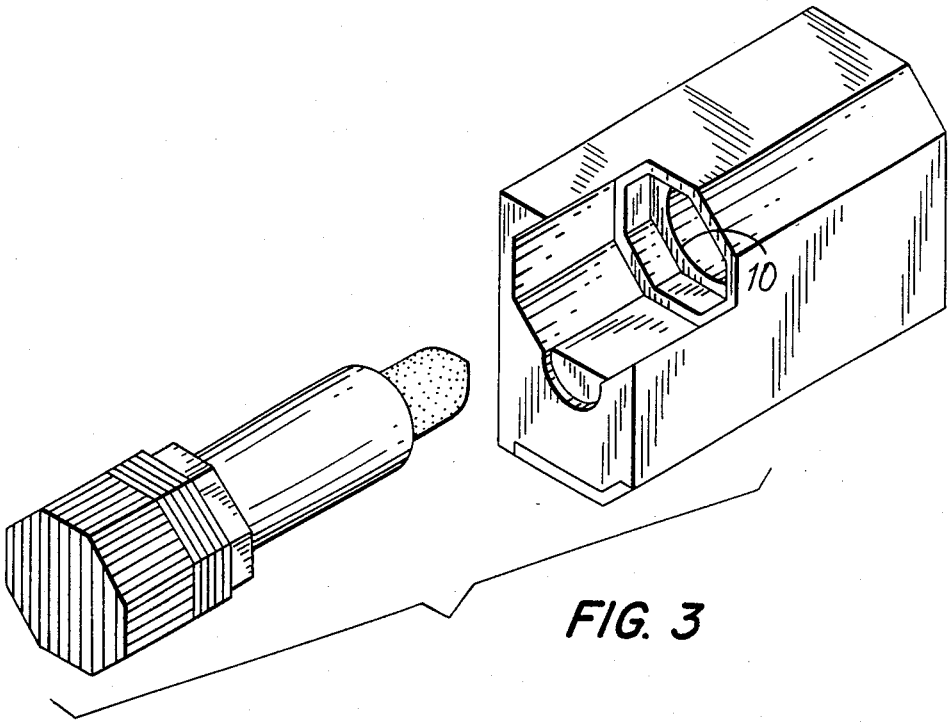
FIG. 3
FIG. 4
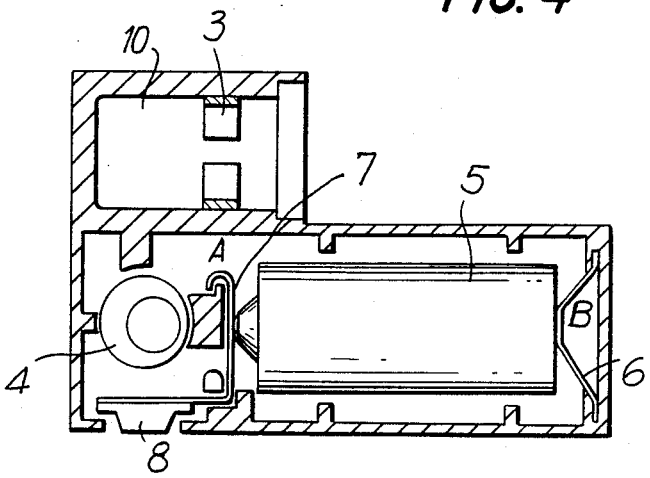

LIPSTICK APPLICATION ASSISTING DEVICE

BACKGROUND OF THE INVENTION

The present invention relates to a lipstick application assisting device.

Lipstick application assisting devices are known in the art. Generally, a lipstick application assisting device includes a housing in form of a lipstick case, such that a lipstick holder with a lipstick can be inserted into the lipstick case and accommodated in it during periods of non-use, and then can be removed for applying the lipstick on user's lips. One of the disadvantages of the known lipstick application assistance devices is that a user does not see her lips during application of a lipstick on them,therefore cannot achieve a high quality application. Moreover, even in the event if a mirror is available or carried by a user, the application of lipstick still encounters some difficulties since there are many places with insufficient illumination, which again make difficult an accurate application of the lipstick.

SUMMARY OF THE INVENTION

Accordingly, it is an object of the present invention to provide a lipstick application assisting device which is an improvement of the existing devices of this type.

More particularly, it is an object of the present invention to provide a lipstick application assisting device which allows the user to apply lipstick in situations where no mirrors are available and no illumination is provided.

In keeping with these objects and with others which will become apparent hereinafter, one feature of the present invention resides, briefly stated, in a lipstick application assisting device which has a housing, a receptacle formed in the housing for accommodating a lipstick, a mirror provided on the housing, and an illuminating element which includes a power supply activated by a switch and an electrical light source supplied from the power supply and directing its light toward the user's lips so as to illuminate the user's lips and to obtain in the mirror an illuminated image of the user's lips.

When the lipstick application assisting device is designed in accordance with the present invention it achieves the above specified objects.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a perspective view of the inventive lipstick application assisting device, showing rear, top and lateral sides and also a lipstick holder with a lipstick;

FIG. 4 is a front view of the inventive application assisting device, in a section taken through an illuminating unit and a lipstick holder receptacle;

DESCRIPTION OF A PREFERRED EMBODIMENT

Figure 1:
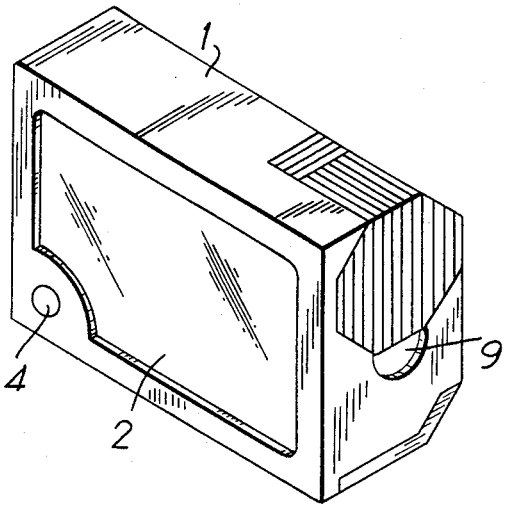
FIG. 1 is a perspective view of a lipstick application assisting device in accordance with the present invention, showing substantially front, upper and lateral sides of the device, with a lipstick inserted in it.
Figure 2:
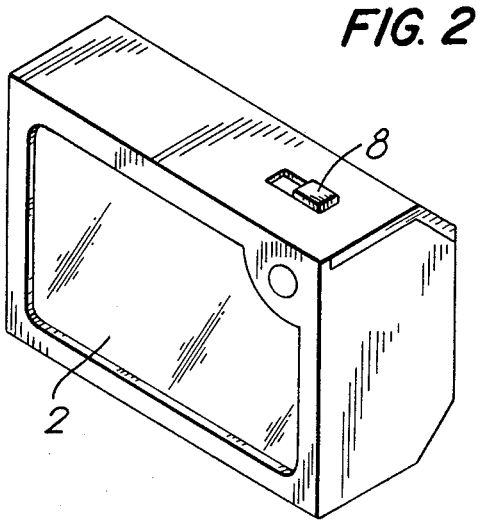
FIG. 2 is a perspective view of the inventive lipstick application assisting device, showing front, bottom and lateral sides.

A lipstick application assisting device in accordance with the present invention has a housing which is identified as a whole with reference numeral 1. The housing has a receptacle which is formed so as to accommodate at least a portion of a lipstick holder with a lipstick. The shape of the receptacle substantially corresponds to the shape of the lipstick holder as shown for example in FIG. 3. More particularly, the lipstick holder has for example stepped portions and the receptacle 10 is formed with stepped recesses successively arranged one after the other. When the lipstick holder with the lipstick is inserted in such a receptacle, it can be held there by a snap action. On the other hand, to provide a stronger hold and also to make the receptacle adjustable to the lipstick holders of different sizes and shapes, an additional spring element 3 can be inserted in the receptacle to directly receive the lipstick holder and to hold it by the spring action.

The housing 1 is provided on its one side with a mirror 2 which occupies a major part of the front surface. The mirror 2 can be a separate element attached to the front surface or the whole front surface can be formed as a mirror. A bulb 4 extends outwardly beyond the front surface of the housing and can be located in one corner of the front surface, in which for example a portion of the mirror 2 is removed. The bulb 4 is a part of an illuminating unit which is shown in more detail in FIG. 4. The illuminating unit includes in addition to the bulb 4, a battery 5 accommodated in a space behind the mirror 2. One contact 6 is arranged so that it is in contact with one side of the battery 5 and extends toward the base of the bulb 4. Another contact 7 is arranged so that it is in contact with the opposite side of the battery 5 and can be brought in contact with the side of the bulb 4 by a switch 8 which is actuatable by a user. The switch 8 is preferably located at the lower side of the housing 1.

For applying a lipstick, a user removes the lipstick holder with the lipstick from the receptacle 10 of the housing, positions the housing 1 so that the mirror 2 faces toward the user's lips,. turns on the switch 8 so that the bulb 4 emits light which is directed towards the user's lips, and an illuminated image of the user's lips is obtained in the mirror 2.

Figure 5:
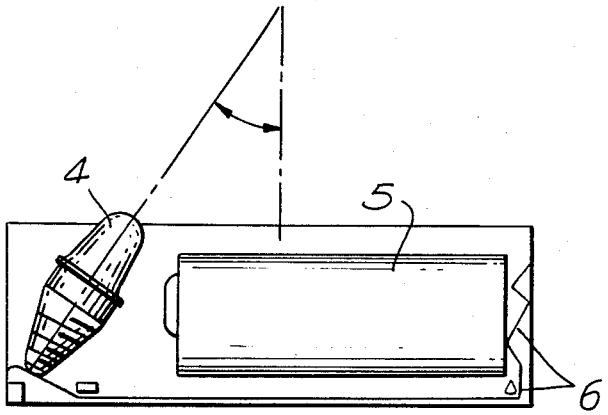
FIG. 5 is a view of the inventive lipstick application assisting device from below, in a section.
Figure 6:
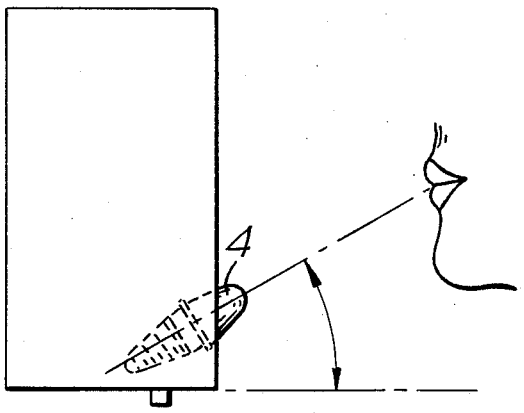
FIG. 6 is a side view of the lipstick application assisting device.

As can be seen from FIG. 5, the bulb is arranged so that its axis is inclined relative to a vertical transverse plane of the mirror 2. With such an arrangement of the bulb 4, its light is directed exactly to the region of the user's lips when the mirror 2 is substantially centered relative to the lips during actual application of a lipstick. This angle can be obtained by calculations in which the distance from the bulb to the vertical transverse plane and the distance from the mirror to the user's lips are introduced. An average distance from the mirror 2 to the user's lips can amount to approximately 4–7 inches, while the distance from the bulb to the vertical transverse plane can amount to approximately 1–1.5 inches.

It has been found that it is very convenient to hold the device in accordance with the present invention so that the mirror is located substantially at the height of the user's lips or somewhat higher. In accordance with an important feature of the present invention, the bulb 4 is also inclined to a horizontal plane so that its light is directed exactly to the region of the user's lips, and in particular not higher than this region, since otherwise the light of the bulb 4 will impinge the user's eyes, which is highly undesirable. Again, this angle can be calculated from an average distance between the mirror 2 and the user's lips which can amount to 4–7 inches, and a vertical distance between the bulb 4 and the user's lips during the use of the device which can amount to approximately 0.5–1 inch.

When the lipstick application assisting device is designed in accordance with the present invention, the user accommodates a lipstick in the device, she can see an image of her lips in the device, and the lips are illuminated so that she can see her lips in any environment.

The switch 8 which is shown in the drawings can be formed so that it provides for an electrical connection between the battery 5 and the bulb 4 only when it is depressed by a user and permanently held by her. On the other hand, it can be formed so that it is sufficient for a user to depress the switch 8, whereupon it is permanently held for example by engagement with a part of the housing. Then, for interrupting the connection between the battery 5 and the bulb 4, the user releases the switch 8 by a further pressing thereagainst.

The electrical contacts 6 and 7 can be formed not only for supplying a power from the battery 5 to the bulb 4, but also as spring elements which support the battery 5 therebetween by applying a spring force to the battery.

Finally, as can be seen from FIG. 1, the housing is provided with a small notch 9 which is formed in the area which is located underneath the lipstick when it is inserted in the receptacle 10. The notch 9 is convenient for introducing a user's finger for engaging the lipstick and removing the latter from the receptacle.

It will be understood that each of the elements described above, or two or more together, may also find a useful application in other types of constructions differing from the types described above.

While the invention has been illustrated and described as embodied in a lipstick application assisting device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A lipstick application assisting device, comprising a housing having an outer front surface; a receptacle formed in said housing so as to accommodate a lipstick; a mirror provided on said housing and occupying a greater portion of said outer front surface of said housing; and an illuminating element including a switch, a power supply activated and deactivated by said switch, and an electric light source supplied from said power supply during its activation and located on a small corner portion of said outer front surface of said housing, said electric light source being inclined relative to said mirror at an angle less than 90° such that its light is directed toward a user'3 s lips so as to illuminate the user's lips and to obtain in said mirror an illuminated image of the user's lips and at the same time does not impinge the user's eyes, said mirror having a substantially rectangular shape with one corner removed, said electric light source being located on said small corner portion of said outer front surface of said housing and in a region vacated by said one corner of said mirror.

2. A lipstick application assisting device as defined in claim 1, wherein said mirror has a vertical transverse plane as considered in a position in which said mirror faces toward the user's lips, said electrical light source being inclined relative to said vertical transverse plane at an angle less than 90°.

3. A lipstick application assisting device as defined in claim 1, wherein said electric light source is inclined relative to a horizontal plane upwardly as considered in a position in which said mirror faces the user's lips at an angle less than 90°.

4. A lipstick application assisting device as defined in claim 1, wherein said power supply of said illuminating element is a battery accommodated in said housing.

5. A lipstick application assisting device as defined in claim 1, wherein said housing has a bottom side as considered in a position in which said mirror faces toward the user's lips, said switch extending outwardly beyond said bottom side of said housing so as to be accessible by a user from below.

6. A lipstick application assisting device as defined in claim 1, wherein said housing has a rear top side as considered in a position in which said mirror faces toward the user's lips, said receptacle being provided in said rear top side of said housing.

7. A lipstick application assisting device as defined in claim 1; and further comprising means for holding a lipstick in said receptacle, said holding means including a spring element provided in said receptacle and arranged to hold a lipstick with a spring force.

8. A lipstick application assisting device as defined in claim 1, wherein said switch is formed so that it activates said power supply when a user depresses said switch and holds it permanently.

9. A lipstick application assisting device as defined in claim 1, wherein said switch is formed so that it activates said power supply when a user depresses said switch and removes a depressing pressure, whereupon said switch is held in said position.

10. A lipstick application assisting device as defined in claim 1, wherein said housing is provided with a notch which in a position in which the lipstick is inserted in said receptacle remains unobstructed so as to allow a user to engage the lipstick through said notch for withdrawing the lipstick from the receptacle.

11. A lipstick application assisting device as defined in claim 1, wherein said illuminating element has two electrical contacts extending from said power supply to said electrical light source and said switch, said electrical contacts being formed as spring contacts arranged to hold said power supply therebetween with a spring action.

12. A lipstick application assisting device as defined in claim 1; and further comprising a lipstick accommodated in said receptacle and withdrawable from the latter.

13. A lipstick application assisting device as defined in claim 1, wherein said housing has a plurality of walls and a front wall which from said outer front surface, said front wall being an integral one-piece wall, and having a first receptacle for receiving said mirror and a second receptacle for receiving said electric light source.

* * * * *